US007757512B2

(12) United States Patent
Park et al.

(10) Patent No.: US 7,757,512 B2
(45) Date of Patent: Jul. 20, 2010

(54) REFRIGERATOR HAVING VARIABLE DELAY CONTROLLER FOR ICE DISPENSER AND METHOD THEREOF

(75) Inventors: Kyong Bae Park, Seoul (KR); Sung Jhee, Seoul (KR); Dong Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 361 days.

(21) Appl. No.: 11/806,992

(22) Filed: Jun. 5, 2007

(65) Prior Publication Data

US 2008/0072612 A1 Mar. 27, 2008

(30) Foreign Application Priority Data

Sep. 21, 2006 (KR) ..... 10-2006-0091855

(51) Int. Cl.

| | |
|---|---|
| ***F25C 5/18*** | (2006.01) |
| ***F25C 1/22*** | (2006.01) |
| ***F25D 23/00*** | (2006.01) |
| ***B60K 20/00*** | (2006.01) |
| ***F16F 15/12*** | (2006.01) |
| ***B65B 59/00*** | (2006.01) |
| ***B65D 47/00*** | (2006.01) |
| ***F16K 25/00*** | (2006.01) |

(52) U.S. Cl. ..... 62/344; 62/302; 62/340; 74/473.29; 74/574.3; 221/15; 222/477; 251/163; 267/205

(58) Field of Classification Search ..... 62/302, 62/340, 344; 74/473.29, 574.3; 188/130, 188/266.1, 266.3, 266.4, 290, 322.19; 221/15; 222/477; 251/163; 267/205

See application file for complete search history.

(56) References Cited

U.S. PATENT DOCUMENTS

| | | | | |
|---|---|---|---|---|
| 3,342,040 | A * | 9/1967 | Dedricks et al. | 62/320 |
| 3,893,550 | A * | 7/1975 | San Pablo De La Rosa | 188/322.19 |
| 3,942,334 | A * | 3/1976 | Pink | 62/266 |
| 4,089,436 | A * | 5/1978 | Marks | 222/504 |
| 4,090,641 | A * | 5/1978 | Lindenschmidt | 222/504 |
| 4,109,455 | A * | 8/1978 | Zacharin | 368/327 |
| 4,759,428 | A * | 7/1988 | Seshimo | 188/312 |
| 5,090,590 | A * | 2/1992 | Hoffman | 221/15 |
| 6,135,173 | A * | 10/2000 | Lee et al. | 141/361 |
| 6,290,038 | B1 * | 9/2001 | Jensen et al. | 188/381 |
| 6,464,052 | B1 * | 10/2002 | Hsiao | 188/290 |
| 6,533,003 | B1 * | 3/2003 | Jacobus et al. | 141/360 |
| 6,951,267 | B2 * | 10/2005 | Heo | 188/266.3 |
| 7,065,975 | B1 * | 6/2006 | Herndon et al. | 62/66 |
| 7,234,569 | B2 * | 6/2007 | Salice | 188/130 |
| 2006/0131324 | A1 * | 6/2006 | Noh et al. | 221/150 R |
| 2006/0150856 | A1 * | 7/2006 | Ambrico | 102/275.7 |

* cited by examiner

*Primary Examiner*—Cheryl J Tyler
*Assistant Examiner*—Filip Zec
(74) *Attorney, Agent, or Firm*—KED & Associates LLP

(57) ABSTRACT

An ice dispenser has a duct cap and a controller to control movement of the duct cap. The controller includes a guide, a first control surface, and a second control surface. A first frictional force between the guide and the first control surface is greater than a second frictional force between the guide and the second control surface. The first frictional force controls the duct cap to move at a first rate and the second friction force controls the duct cap to move at a second rate faster than the first rate.

19 Claims, 9 Drawing Sheets

REFRIGERATOR HAVING VARIABLE DELAY CONTROLLER FOR ICE DISPENSER AND METHOD THEREOF

This application claims priority under 35 U.S.C. §119(*a*) to Patent Application No. 10-2006-0091855 filed in Korea on Sep. 21, 2006, the entire contents of which are hereby incorporated by reference.

BACKGROUND

1. Field

The present invention relates to a refrigerator, and more particularly to a refrigerator having a device for opening and closing an ice duct provided on the refrigerator.

2. Background

In general, a refrigerator keeps a refrigerator compartment and/or a freezer compartment at low temperatures using a coolant-cooling cycle device that includes a compressor, a condenser, an expander, and an evaporator. FIG. 1 is a perspective view of a typical refrigerator, whose freezer compartment and refrigerator compartment are open.

A freezer compartment F and a refrigerator compartment R are separated by a barrier 1. A cooling-cycle device mounted on the main body 2 is used to keep the freezer compartment F and refrigerator compartment R at low temperatures. A freezer compartment door 4 is connected to the main body 2 to open/close the freezer compartment F. A refrigerator compartment door 6 is connected to the main body 2 to open/close the refrigerator compartment R.

The cooling cycle device of the refrigerator includes a compressor for compressing gas coolant; a condenser for radiating heat outside to condense the compressed high temperature and pressure coolant; an expander for decompressing the condensed coolant; and an evaporator for vaporizing the expanded coolant to absorb heat from air circulating in the freezer compartment F and refrigerator compartment R. The circulating air serves to cool the freezer compartment F and refrigerator compartment R.

Refrigerators often include an automatic ice-making device for making ice. In addition, many refrigerators include an ice dispensing mechanism that automatically releases ice to a position outside the refrigerator. Typically, such an ice dispensing mechanism is provided on a door that closes the freezing chamber.

The automatic ice-making device includes an icemaker 8 for making ice F and an ice bank 9 for containing the ice delivered from the icemaker 8. The ice bank 9 includes a delivery unit for delivering and releasing the ice and a motor 10 for rotating the delivery unit. The freezer compartment door 4 includes a dispenser (not shown) for supplying the ice delivered from the ice bank 9 and for supplying water fed from a water supply (not shown). The freezer compartment door 4 further includes an ice duct 12 which acts as a passageway for guiding the ice from the ice bank 9 to the dispenser. An ice duct open/close unit 13 is used for opening and closing the ice duct 12.

FIG. 2 is a perspective view of the ice duct open/close unit of the refrigerator shown in FIG. 1. FIG. 3 is a block diagram of the automatic ice making device of the refrigerator shown in FIG. 1.

Referring to FIG. 2, the ice duct open/close unit 13 includes a duct cap 21 arranged to open and close the ice duct 12. A lever 22 extends outside the freezer duct so that it can be operated by a user. A micro switch 23 is activated by the lever 22. A rotational axis 24 is arranged so that the duct cap 21 can rotate to open and close the ice duct 12. A solenoid 25 is used to rotate the duct cap 21 to open the ice duct 12 and to close the ice duct 12. A spring 26 elastically supports the rotational axis 24 so that the duct cap 21 is biased toward the closed position.

As shown in FIG. 3, the refrigerator further includes a controller 30 for operating the motor 10 and solenoid 24 based on an input of the micro switch 23. If a user presses the lever 22, that is, a force is exerted on the lever 22, then the lever 22 turns on the micro switch 23. As a result, the controller 30 operates the solenoid 25 and the motor 10 of the ice bank 9. The solenoid 25 rotates the rotational axis 24 and duct cap 21, thus opening the ice duct 12. Ice, which has been contained in the ice bank 9, is released from the ice bank 9 and falls down into the ice duct 12 when the ice bank 9 and motor 10 are operated. Ice then passes through the opened ice duct 12 and is released by the dispenser.

If the user releases the lever 22, namely, the force exerted on the lever 22 is eliminated, the lever 22 turns off the micro switch 23. As a result, the controller 30 returns the solenoid 25 to the original location after a predetermined period of time, e.g. 4 seconds has expired. This allows any ice pulled from the ice bank to be dispensed before the solenoid 25 returns to its original location and closes the ice duct. When the solenoid 25 returns to the original location, the spring 26 rotates the rotational axis 24 and the duct cap 21 to thereby close the ice duct 12.

The solenoid used to open and close the ice duct in the conventional refrigerator is primarily used so that there can be a delay between the time a user releases the lever, and the time that the duct is closed. However, the solenoid increases the cost of the refrigerator, and generates a significant amount of noise in operation.

BRIEF DESCRIPTION OF THE DRAWINGS

The embodiments will be described in detail with reference to the following drawings in which like reference numerals refer to like elements, and wherein.

DETAILED DESCRIPTION

Figure 1:
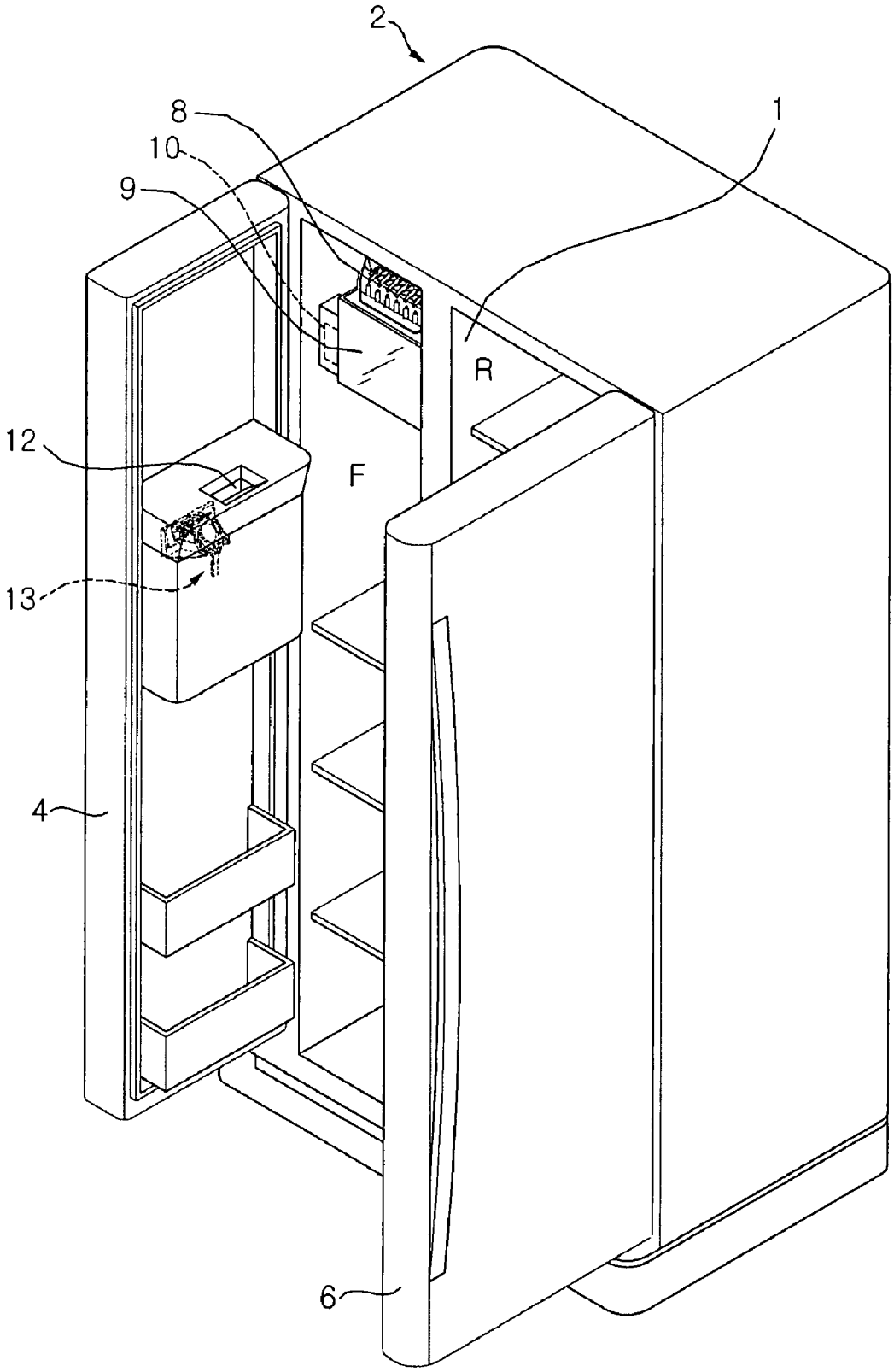
FIG. 1 (RELATED ART)
FIG. 1 is a perspective view of a related art refrigerator.
Figure 2:
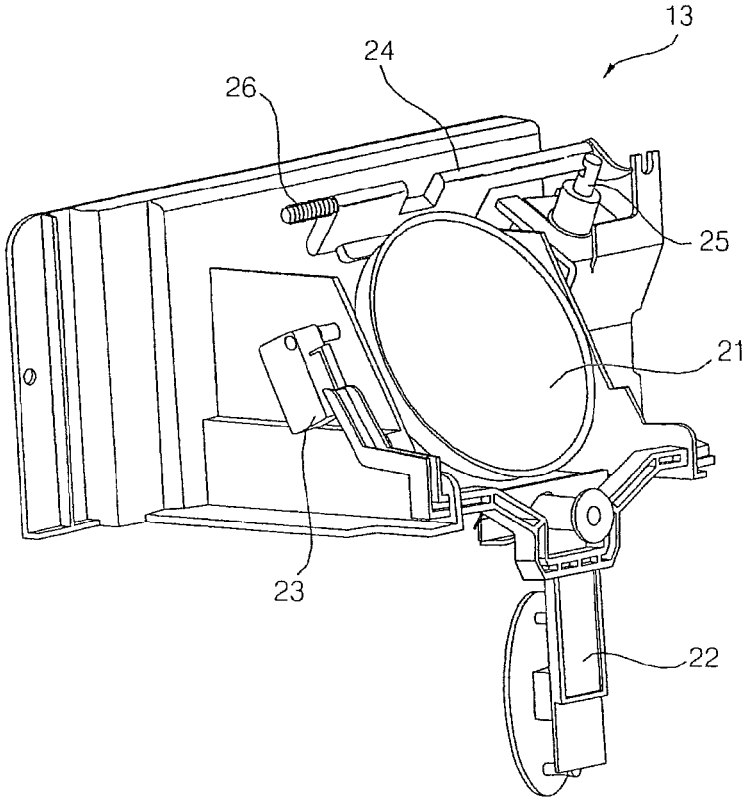
FIG. 2 (RELATED ART)
FIG. 2 is a perspective view of an ice duct open/close unit for the refrigerator shown in FIG. 1.
Figure 3:
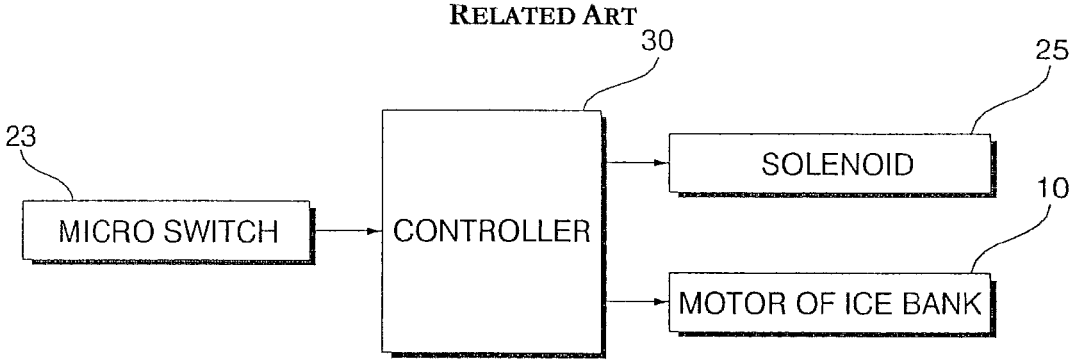
FIG. 3 RELATED ART
FIG. 3 is a block diagram of the automatic ice making device of the refrigerator shown in FIG. 1.
Figure 4:
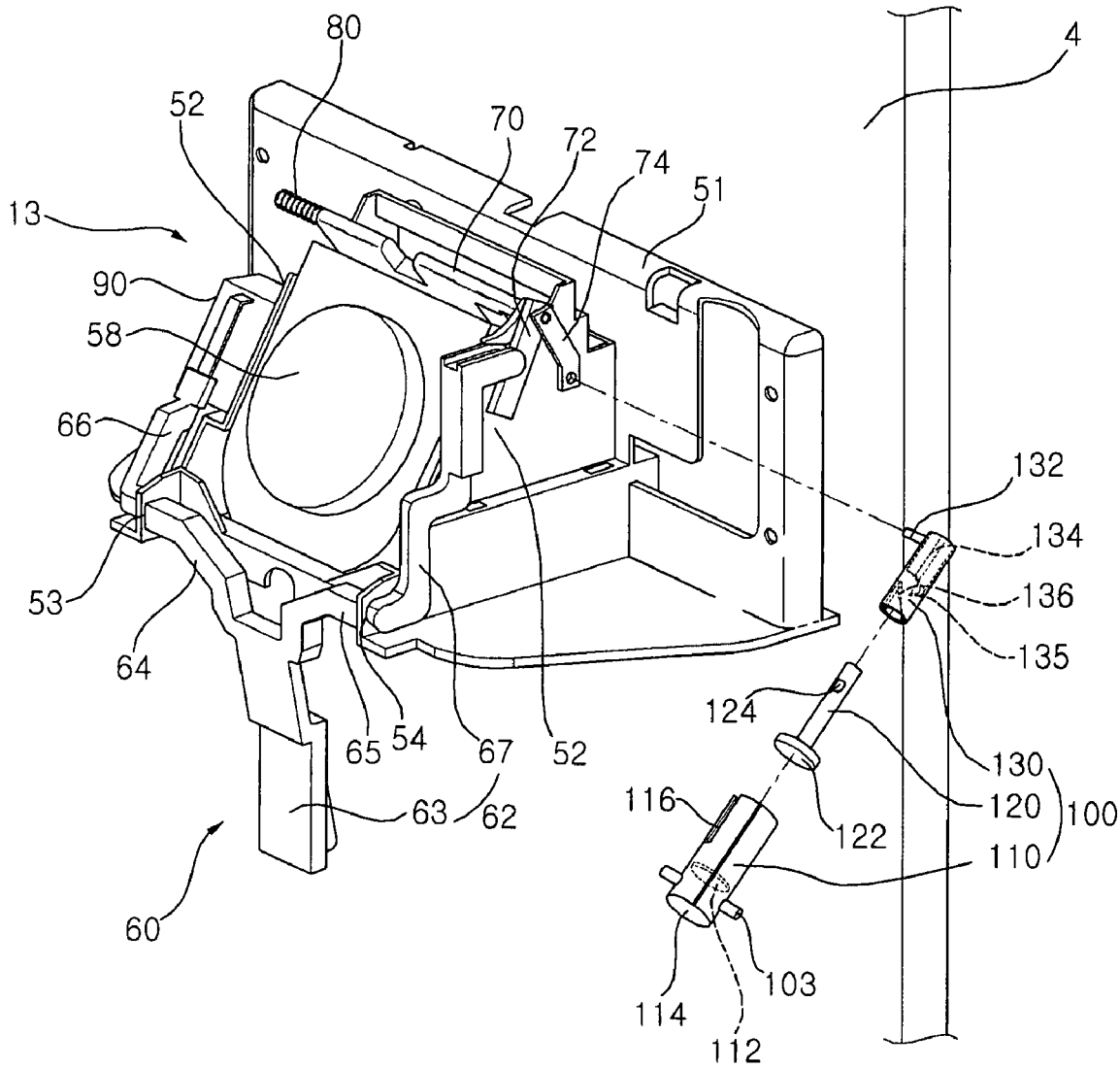
FIG. 4 is an exploded perspective view of a part of an ice duct open/close unit of a refrigerator according to a first embodiment.
Figure 5:
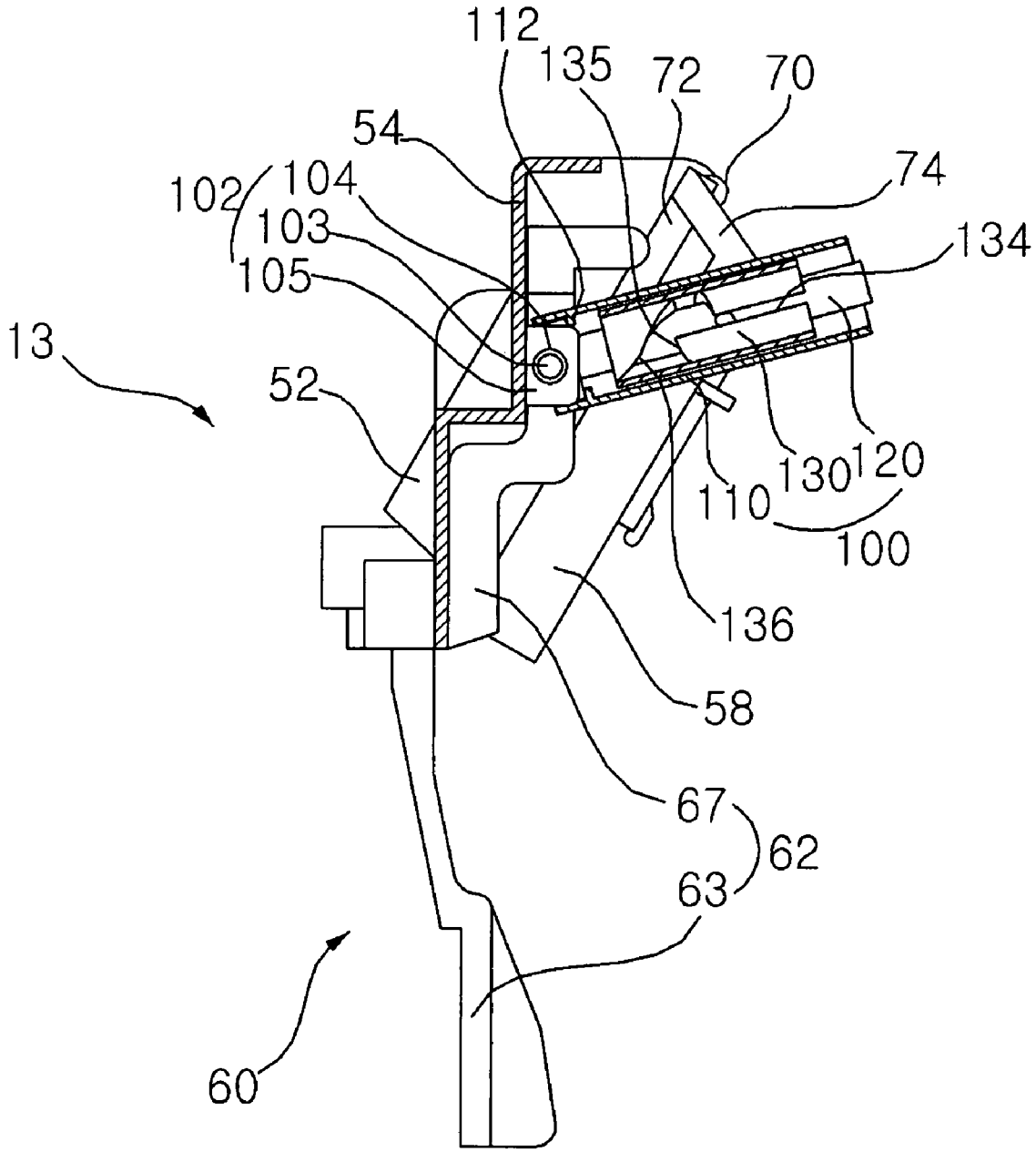
FIG. 5 is a partial cross sectional view of the duct cap of FIG. 4, when the duct cap closes the ice duct.
Figure 6:
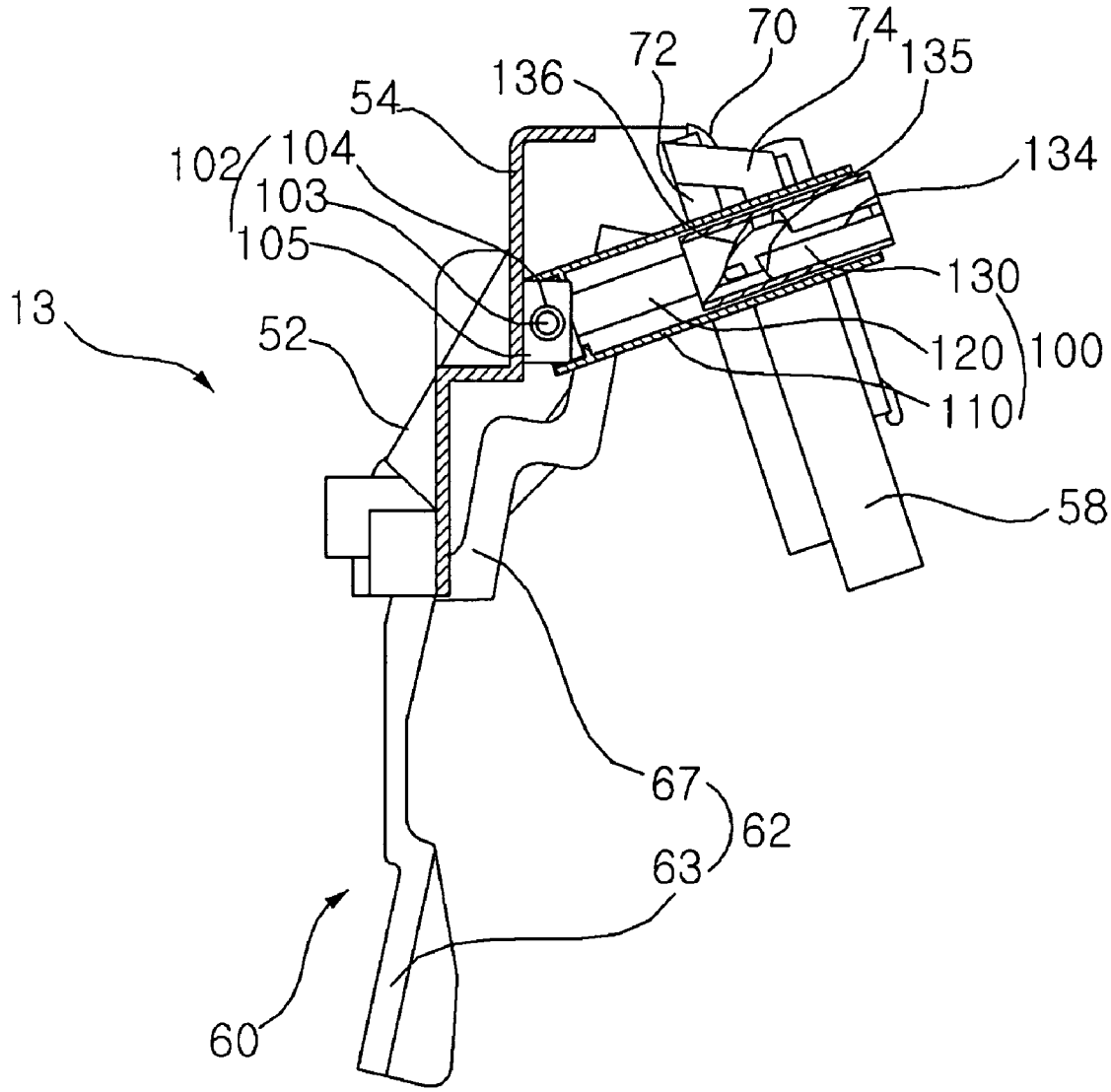
FIG. 6 is a partial cross sectional view of the duct cap of FIG. 4, when the duct cap opens the ice duct.

FIG. 4 is an exploded perspective view of a part of an ice duct open/close unit of a refrigerator. FIG. 5 is a partial cross sectional view of the duct cap of FIG. 4, when the duct cap closes the ice duct, and FIG. 6 is a partial cross sectional view of the duct cap of FIG. 4, when the duct cap opens the ice duct.

The ice duct open/close unit 13 includes a funnel 51 connected to a freezer compartment door 4 by connection members such as screws, as shown in FIG. 4. The funnel 51 pivotably supports a lever 62 of an open/close unit 60. The funnel 51 prevents ice that has passed through the ice duct 12 from jumping out from the inside of the dispenser. A duct portion 52 that communicates with the lower part of the ice duct 12 is provided at the lower side of the ice duct 12.

A micro switch 90 located on a side of the funnel 51 is operated by a lever 62 of the open/close unit 60. The micro switch 90 is preferably provided beside the duct portion 52.

The ice duct open/close unit 13 includes a duct cap 58 for opening and closing the ice duct 12. The open/close unit 60 is used to make the duct cap 58 perform the open/close operations. A time delay unit 100 is used to delay the closing of the duct cap 58 after the lever 62 of the open/close unit 60 has been released.

In different embodiments, the duct cap 58 can slide or pivot to open and close the lower side of the ice duct 12. The following discussion focus on an embodiment where the duct cap 58 is arranged pivot to open and close the ice duct 12. However, in other embodiments, the duct cover could move in other ways to open and close the ice duct.

The duct cap 58 is arranged to be rotated about its upper part. When in the opened position, the duct cap allows the ice duct 12 to communicate with the duct portion 52. When in the closed position, the duct cap 58 is arranged between the duct portion 52 of the funnel 51 and the ice duct 12 to block the ice duct 12.

The open/close unit 60 includes a lever 62 manipulated by a user, a rotational axis 70 mechanically connected to the lever 62 to rotate the duct cap 58, and a spring 80 for elastically supporting at least one of the lever 62 and the rotational axis 70 to rotate the duct cap 58 to the closed position. The lever 62 includes a vertical bar 63 positioned at an inside space of the dispenser. The vertical bar 63 is configured to be pressed rearward by a user. Left and right horizontal bars 64, 65 spread toward both sides from the top end of the vertical bar 63. The left and right horizontal bars 64, 65 are pivotably supported by lever supporters 53, 54 provided at the left and right parts of the rear end of the duct portion 52.

A switch connection bar 66 is attached to the left horizontal bar 64, and the switch connection bar 66 activates the micro switch 90. A rotational axis connection bar 67 is attached to the right horizontal bar 65 and it is connected to the rotational axis 70.

The rotational axis 70 is arranged at the upper side of the duct portion 52 of the funnel 51. A lever connection portion 72 protrudes from one end of the rotational axis 70 and is pivotably connected to the axis connection bar 67 by a hinge, pin or the like. The rotational axis 70 is provided with a cap connection portion 74 connected to a cap 130 of a time delay unit 100 to be described later.

A spring 80 has one side connected to the funnel 51 and the other side connected to the rotational axis 70. The spring 80 may be a coil spring or a torsion spring.

The time delay unit 100, which is connected to at least one of the duct cap 58 and the open/close unit 60, acts to delay the closing of the duct cap 58. Preferably, the time delay unit 100 is formed so that it does not significantly impede rotation of the lever 62 and the rotational axis 70 when the mechanism is moving toward the open position, which allows the duct cap 58 to be quickly and easily opened.

The time delay unit 100 comprises a damper case 110 attached to the refrigerator. A core 120 is arranged inside of the damper case 110 in a rotatable manner. A cap 130 connected to one of the duct cap 58 and the open/close unit 60 is arranged inside of the damper case 110 such that it can move along a straight line.

The damper case 110, as shown in FIGS. 5 and 6, is mounted on an installation plate 54 provided next to the duct portion 52 of the funnel 51. The damper is attached to the installation plate 54 by a connection member and may be rotatable around a hinge 102.

The damper case 110 is attached to the installation plate 54 by a hinge 102 in a rotatable manner. A hinge bar 103 protrudes from the damper case 110, and the installation plate 54 is provided with a hinge hanger 105 having a hinge hole 104 that pivotably supports the hinge bar 103.

Referring to FIGS. 4 to 6, a locking member 112 protrudes from the inner circumference of the damper case 110 so that the core 120 cannot be moved in the longitudinal direction along a straight line. The damper case 110 is also provided with a stopper 114 to block the core 120 from moving along a straight line in a direction opposite to the locking member 112.

Referring again to FIG. 4, the damper case 110 can be assembled by combining the separately-manufactured stopper 114 with one end of a cylindrical cavity through press-fitting, screwing, or adhering, or can be completed by combining a plurality of case members such as the locking member 112 and stopper 114, which are separately provided, with one another through an attachment method, e.g. press-fitting or adhering.

The damper case 110 is provided with a connection portion guide 116 that extends in the longitudinal direction. The connection portion guide allows a connection portion 132 of the cap 130 to protrude from the damper case 110. The guide 116 also guides linear movement of the cap 130 within the damper case 110, and guides the straight-line movement of the connection portion 132.

A locking jaw 122, which is confined within the damper case 110, protrudes from the core 120 so that the core 120 is not moved along a straight line together with the cap 130 in the straight-line movement. That is, the locking jaw 122 prevents the core from moving in one longitudinal direction because of the locking member 112 of the damper case, and the core is prevented from moving in the opposite longitudinal direction because of the stopper 114. A protrusion 124 also projects from the core 120. The protrusion 124 extends perpendicularly to the longitudinal direction of the core 120.

The cap 130 is moved back and forth along a straight line in connection with one of the duct cap 58 and open/close unit 60 during an opening/closing operation of the duct cap 58. Discussion will now be restricted to a case where the connection portion 132 is connected to the rotational axis 70.

The connection portion 132 of the cap 130 is connected or adhered to the cap connection portion 74 of the rotational axis 70 by a connection member, e.g. a screw or adhesive. The cap 130 is formed approximately in the shape of a cylindrical cavity. It includes a straight portion 134, an inclined portion 135, and a protrusion guidance portion 136 formed along its inner circumference.

The straight portion 134 guides the protrusion 124 on the core while the cap 130 is moved back and forth along a straight line. Two sides of the straight portion 134A, 134B are spaced to face each other in the circumferential direction. An opening is formed between the two sides of the straight portion 134, whose width is greater than that of the protrusion 124.

As the cap moves longitudinally within the case 110, the connection portion 132 of the cap will be moved down the length of connection guide portion 116 of the case 110.

Although the cap can move in the longitudinal direction within the case 110, the connection portion 132 protruding from the connection guide portion 116 prevents the cap from rotating within the case.

In contrast, the core 120 is prevented from moving longitudinally along the inside of the case 110 because the locking jaw 122 is trapped between the stopper 114 and the locking member 112 of the case 110. However, the core is free to rotate within the case.

Figure 7:
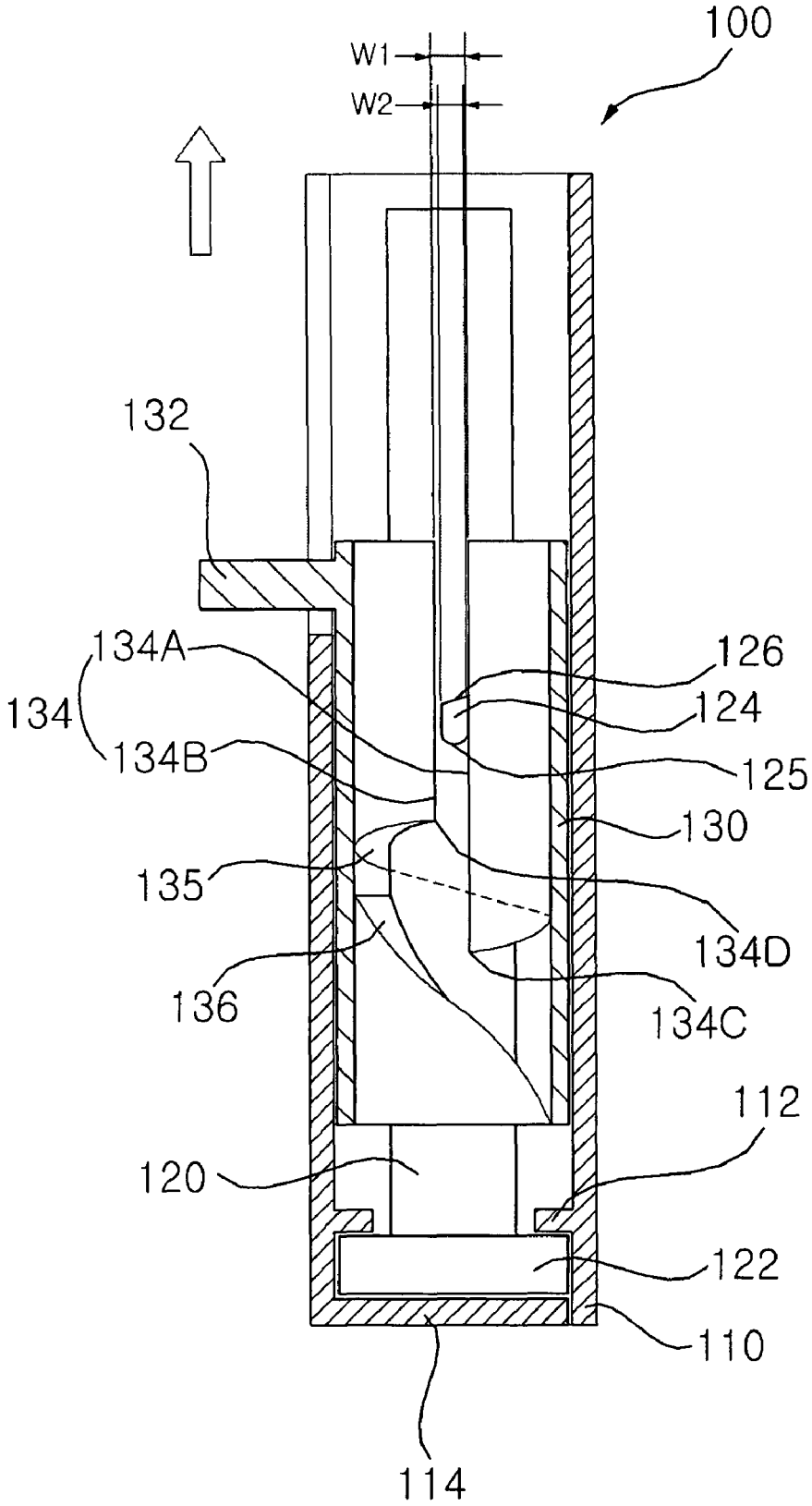
FIG. 7 is an expanded cross sectional view of a time delay unit at an initial opening step for the duct cap shown in FIGS. 4 to 6.
Figure 8:
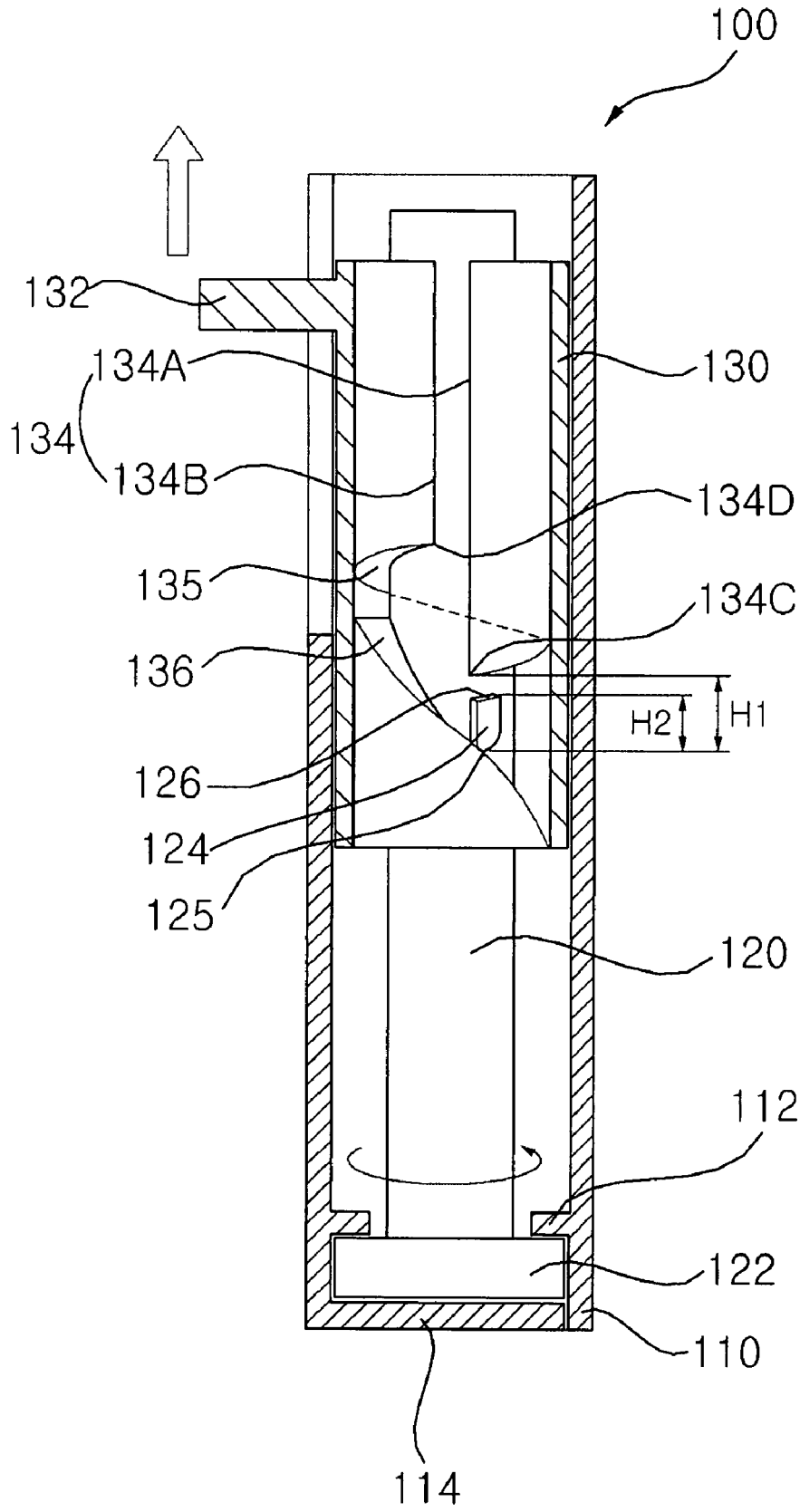
FIG. 8 is an expanded cross sectional view of the time delay unit at the final opening step.

As the cap moves from the position shown in FIG. 7 upward towards the position shown in FIG. 8, the protrusion 124 on the core rides along the straight portion 134 of the cap. This allows the cap to move quickly and easily. However, as the cap nears the end of its travel, the protrusion 124 will encounter the inclined portion 135 of the cap. The inclined portion 135, will act to rotate the protrusion 124, and the attached core as the cap 130 continues to move.

Figure 9:
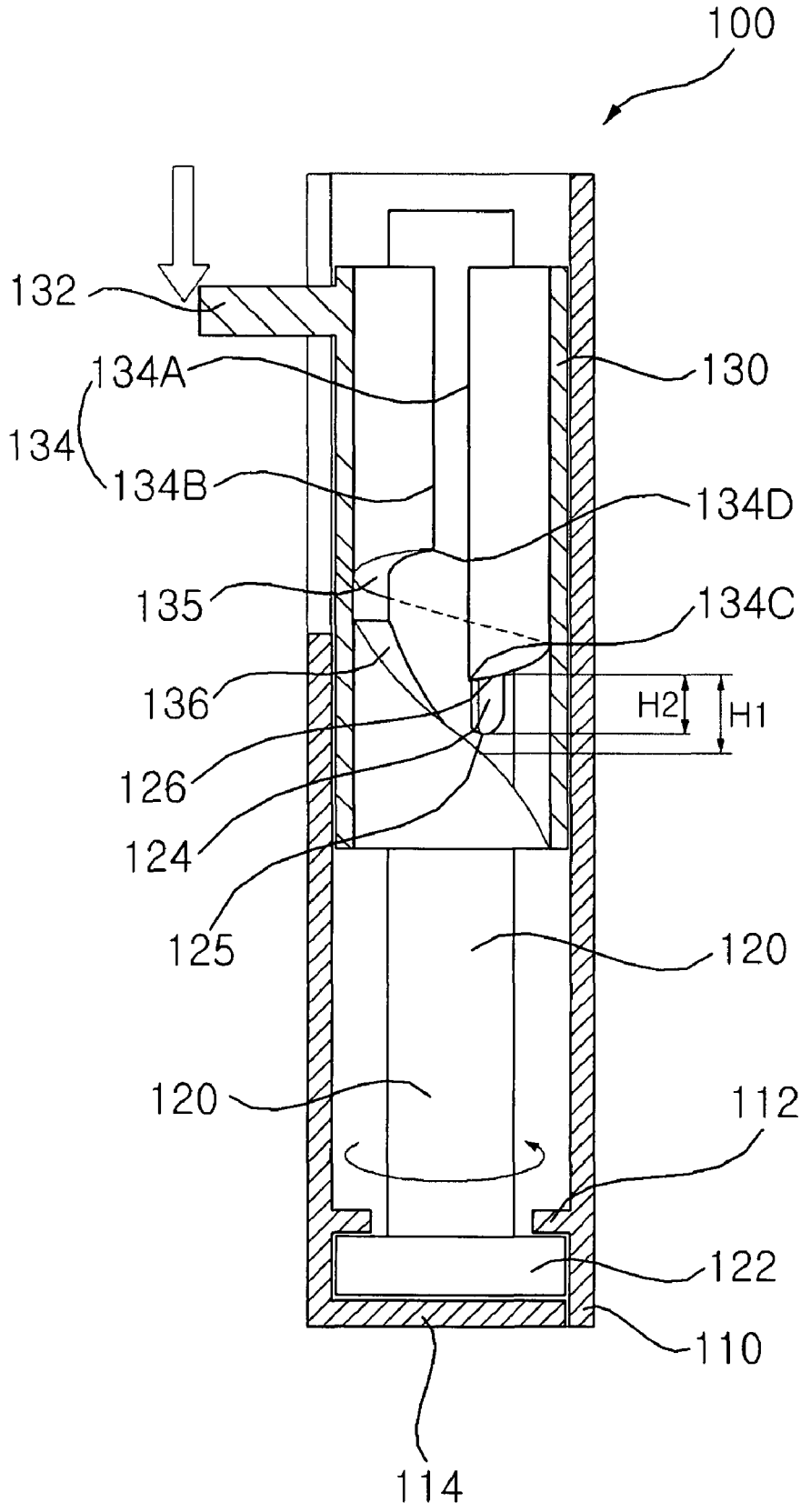
FIG. 9 is an expanded cross sectional view of the time delay unit at the initial closing step.
Figure 10:
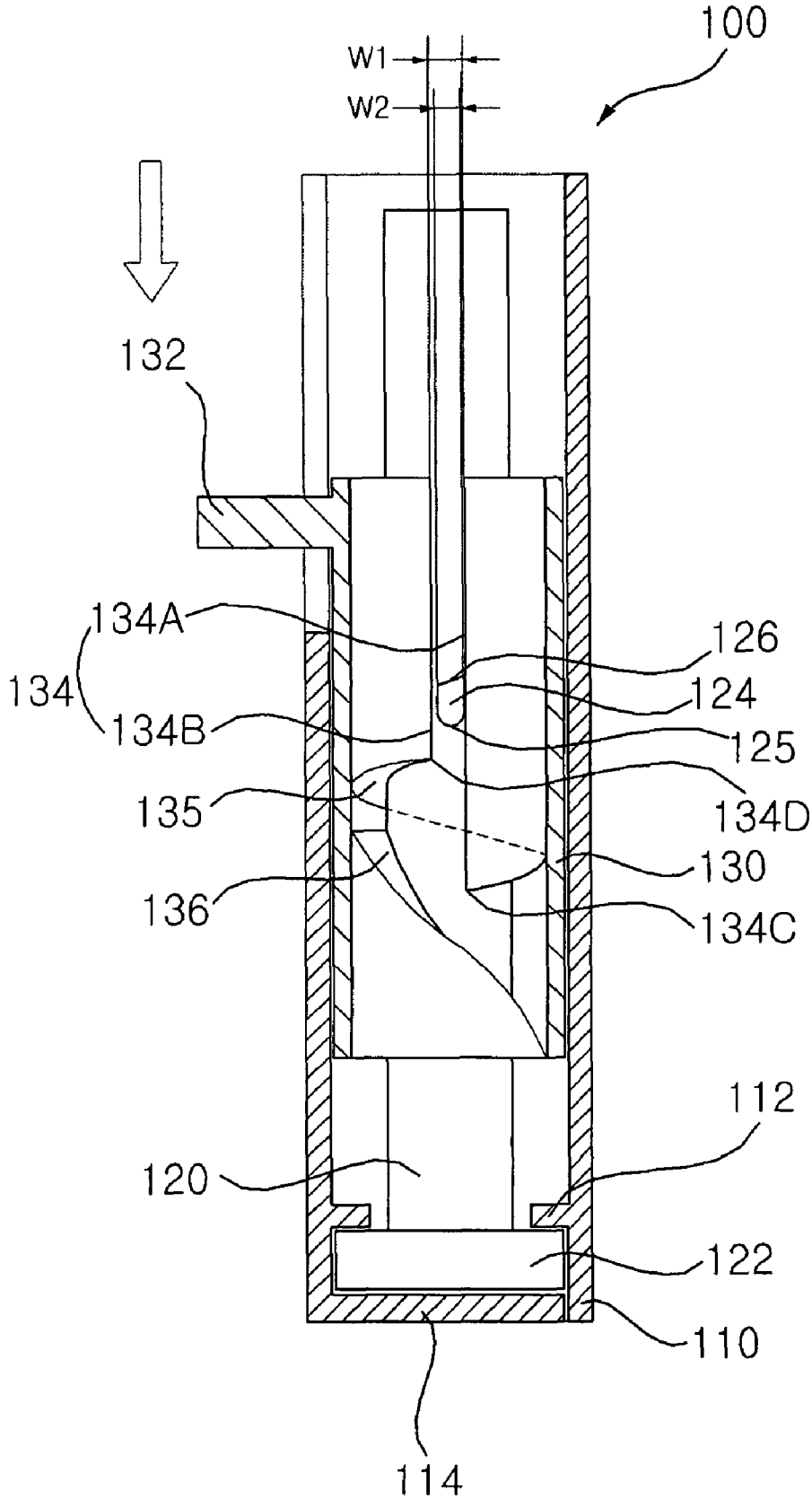
FIG. 10 is an expanded cross sectional view of the time delay unit at the final closing step.

FIG. 7 is an expanded cross sectional view of the time delay unit at an initial opening position. This is the position it would have before the duct cap 58 begins to open. FIG. 8 is an expanded cross sectional view of the time delay unit at a final opening step, at which point the duct cap is fully opened. FIG. 9 is an expanded cross sectional view of the time delay unit at an initial closing step, where the duct cap is just beginning to close. FIG. 10 is an expanded cross sectional view of the time delay unit at a final closing step, where the duct cap is returning to the fully closed position.

Referring to FIG. 7, the protrusion 124 is formed to have a shorter width W2 than a width W1 between the two sides 134A, 134B facing each other. Referring to FIG. 8, the protrusion 124 is formed to have a shorter length H2 than a length H1 between the inclined portion 135 and protrusion guidance portion 136 on the cap 130.

The protrusion 124 is formed so that a frictional force between the protrusion 124 and the inclined portion 135 on one hand, and the friction between the protrusion 124 and the guidance portion 136 on the other hand, is different. As a result, the friction generated by the protrusion 124 varies depending on whether the duct cap is opening or closing. A first frictional portion 125 of the protrusion 124 is configured to have a smaller frictional force than a second frictional portion 126 of the protrusion 124.

In some embodiments, the first frictional force portion 125 is configured such that it will be put in point-contact with the protrusion guidance portion 136 during an opening operation. The second frictional force portion 125 is configured to be in line-contact or surface-contact with the inclined portion 135 during a closing operation. In alternative embodiments, the first frictional force portion 125 may be configured to be put in line-contact with the protrusion guidance portion 136 during an opening operation, and the second frictional force portion 126 may be configured to be in surface-contact with the inclined portion 135. Either way, the result will be greater friction during the closing operation than during the opening operation.

The description will now be restricted to a case where the first frictional force portion 125 is put in line-contact with the inclined surface of the protrusion guidance portion 136, and where the second frictional force portion 126 is put in surface-contact with the inclined surface of the inclined portion 135. Specifically, the first frictional force portion 125 is a rounded portion that is brought into line-contact with the inclined surface of the protrusion guidance portion 136, and the second frictional force portion 126 is an inclined surface portion in surface-contact with the inclined surface of the inclined portion 135.

Referring to FIG. 8, because the first frictional force portion 125 will be in line contact with the inclined surface of the protrusion guidance portion 136, a small frictional force is provided between them. As a result, the cap 130 moves rapidly when the duct cap is opening. Referring to FIG. 9, because when the second frictional force portion 126 is in surface contact with the inclined surface of the inclined portion 135, a great frictional force is provided between them. As a result, the cap 130 moves slowly when the duct cap first begins the closing operation.

In addition, note that one side 134A of the straight portion 134 is formed longer than the other side 134B. The inclined portion 135 is formed in the spiral direction from one end 134C of the one side 134A to the other end 134D of the other side 134B. The protrusion guidance portion 136 is formed spirally in the opposite direction to the inclined portion 135.

That is, if the protrusion guidance portion 136 is formed in a downwardly inclined manner with respect to the rotational direction of the protrusion 124, then the inclined portion 135 is formed in an upwardly inclined manner with respect to the rotational direction of the protrusion 124.

As shown in FIGS. 4 to 6, if a user presses the vertical bar 63 of the lever 62, then the lever 62 rotates with the horizontal bars 64, 65 supported by the lever supporters 53, 54 of the funnel 51. The rotational connection bar 67 rotates the rotational axis 70. As the rotational axis 70 turns, it elastically compresses the spring 80 and the duct cap 58 turns within the duct portion 52, thereby opening the ice duct 12.

When the lever 62 revolves, the cap 130, as shown in FIGS. 5 and 7, is moved along a straight line in a direction such that it retreats from the damper case 110. The cap 130 is moved along a straight line because of the connection portion 132 which extends out the connection guide portion 116 on the damper case 110.

During the initial opening movement, the protrusion 124 on the core 120 rides down the straight portion 134 of the cap 130. Once the cap 130 retreats a certain distance, the straight portion 134 becomes distant from the protrusion 124 and the protrusion guidance portion 136 contacts the protrusion 124. The first frictional force portion 125 of the protrusion 124 is put in line contact with the protrusion guidance portion 136, which produces a relatively small amount of friction. As the cap 130 continues to move, the protrusion guidance portion 136 makes the protrusion 124 revolve along the protrusion guidance portion 136, and the core 120 core rotates until the protrusion 124 is opposite to the inclined surface of the inclined portion 135, as shown in FIG. 8.

Because the protrusion guidance portion 136 creates a relatively small frictional force with the protrusion 124 after the protrusion has left straight portion 134, the cap 130 moves swiftly and the lever 62 and rotational axis 70 rotate fast without any disturbance from the core 120 and cap 130. This ensures the duct cap 58 quickly opens the ice duct 12.

When the lever 62 rotates, the switch connection bar 66 of the lever 62 operates, i.e. turns on the micro switch 90, and the controller 30 receives signals from the micro switch 90 to operate the motor 10 of the ice bank 9. When the motor 10 of the ice bank 9 operates, ice contained in the ice bank 9 is released from the ice bank 9 and falls down the ice duct 12, and passes through the opened ice duct 12 and duct portion 52 of the funnel 51 and is released to the dispenser.

When the user releases the lever 62, i.e. eliminates the force exerted on the lever 62, and the spring 80 causes the rotational axis 70 to rotate in a closing direction. This also pushes the cap 130 with a force causing straight-line movement of the cap back into the damper case 110.

As described above, when the rotational axis 70 rotates reversely, the switch connection bar 66 of the lever 62 turns off the micro switch 90, and the controller 30 stops the operation of the motor 10. This stops the ice from being released from the ice bank 9.

As the cap 130 first begins to move along a straight line in the direction back into the damper case 110, as shown in FIG. 9, the inclined surface of the inclined portion 135 is put in surface-contact with the second frictional force portion 126, of the protrusion 124. The surface contact generates a relatively large frictional force between the second frictional force portion 126 and the inclined surface of the inclined portion 135.

As the spring 80 continues to exert a force pushing the cap back into the damper case, the protrusion 124 will ride along the inclined portion 135, which will cause the core to rotate in the reverse direction. Because of the large frictional force, however, the core 120 will slowly rotate, and the cap 130 is slowly moved forward.

When the cap 130 moves forward slowly, the lever 62 and rotational axis 70 rotate at a slow speed so as to gradually close the ice duct 12. This allows the remaining ice to fall down from the ice bank 9 to the dispenser while the ice duct 12 is still open.

Eventually, the protrusion 124 of the core 120 moves off the inclined portion 135 and enters the straight portion 134, as shown in FIG. 10. Once the protrusion 124 starts to escape from the inclined portion 135, and into the straight portion 134, the large frictional force will be removed, and the restoring force of the spring will cause the cap 130 to move fast along a straight line into the damper case 110. At the same time, the lever 62 and rotational axis 70 are reversely rotated at a relatively high speed without any disturbance from the core 120 and cap 130, and the duct cap 58 quickly closes the ice duct 12.

A refrigerator as described above is less expensive to make and is also quieter in operation compared to the prior art refrigerators which use a solenoid as an electronic time delay unit.

In addition, a refrigerator as described above allows the time delay unit to be more compact, since a connection portion that is connected to one of the duct cap and rotational axis protrudes from the cap, and the damper case is provided with a connection portion guide through which the connection portion passes when the cap moves back and forth along a straight line.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other embodiments.

Although a number of illustrative embodiments have been described, it should be understood that numerous other modifications and embodiments can be devised by those skilled in the art that will fall within the spirit and scope of the principles of this disclosure. More particularly, various modifications are possible in the component parts and/or arrangements of the subject combinations while still falling within the scope of the disclosure, the drawings and the appended claims. In addition to variations and modifications in the component parts and/or arrangements, alternative uses will also be apparent to those skilled in the art.

What is claimed is:

1. A refrigerator, comprising:

an ice dispenser to dispense ice through an ice duct;

a duct cap mounted on the ice dispenser that selectively opens and closes the ice duct; and a damper that is operably coupled to the duct cap, wherein the damper controls movement of the duct cap when the duct cap moves from an open position to a closed position, the damper comprising:

a case coupled to the ice dispenser;

a core mounted in the case; and a cap mounted in the case, wherein the cap is coupled to the duct cap and moves within the case relative to the core as the duct cap moves between the opened and closed positions, and wherein a protrusion on the core interacts with at least one guide surface on the cap, the interaction between the protrusion and the at least one guide surface causing friction which tends to slow movement of the cap within the case.

2. The refrigerator of claim 1, wherein the friction caused by interaction between the protrusion and the at least one guide surface is greater when the duct cap first begins to move from the opened position towards the closed position than when the duct cap is moving from the closed position to the opened position.

3. The refrigerator of claim 2, wherein a first surface of the protrusion interacts with a first guide surface on the cap as the duct cap moves from the closed position to the opened position, and wherein a second surface of the protrusion interacts with a second guide surface on the cap as the duct cap moves from the opened position toward the closed position.

4. The refrigerator of claim 3, wherein the first surface of the protrusion makes point contact with the first guide surface, and wherein the second surface of the protrusion makes line or surface contact with the second guide surface.

5. The refrigerator of claim 3, wherein the first surface of the protrusion makes line contact with the first guide surface, and wherein the second surface of the protrusion makes surface contact with the second guide surface.

6. The refrigerator of claim 1, wherein the at least one guide surface on the cap comprises:

a first guide surface that extends in a straight line, wherein the protrusion is guided along the first guide surface as the duct cap moves into and away from the closed position;

a second guide surface that extends in a helical direction on the cap, wherein the protrusion is guided along the second guide surface as the duct cap moves from the closed position to the opened position as the duct cap nears the open position; and a third guide surface that extends in a helical direction on the cap, wherein the protrusion is guided along the third guide surface as the duct cap moves from the opened position towards closed position as the duct cap is just leaving the opened position.

7. The refrigerator of claim 6, wherein a first amount of friction is generated between the protrusion and the first guide surface, wherein a second larger amount of friction is generated between the protrusion and the second guide surface, and wherein a third still larger amount of friction is generated between the protrusion and the third guide surface.

8. The refrigerator of claim 6, wherein the core is free to rotate within the case, but is not free to translate along a longitudinal direction of the case.

9. The refrigerator of claim 8, wherein a locking jaw on the core is confined between a stopper and a locking member of the case to prevent longitudinal movement of the core within the case.

10. The refrigerator of claim 8 wherein the cap is free to translate along the longitudinal direction of the case, but is not free to rotate within the case.

11. The refrigerator of claim 10, wherein a connection portion of the cap extends through a longitudinally extending guide slot on the case to prevent the cap from rotating within the case.

12. The refrigerator of claim 11, wherein the connection portion is operably coupled to the duct cap such that movement of the duct cap between the opened and closed positions causes the cap to translate in the longitudinal direction of the case.

13. The refrigerator of claim 10, wherein when the protrusion is guided along the second and third guide surfaces as the cap translates in the longitudinal direction, and wherein the interaction between the protrusion and the second and third guide surfaces causes the core to rotate within the case.

14. The refrigerator of claim 13, wherein a separation distance between the second and third guide surfaces is greater than a height of the protrusion.

15. The refrigerator of claim 6, wherein the first guide surface comprises a longitudinally extending slot in the cap, and wherein a width of the slot is greater than a width of the protrusion.

16. The refrigerator of claim 15, wherein a first side of the slot extends a greater distance along the cap than a second side of the slot.

17. The refrigerator of claim 16, wherein an end of the first side of the slot joins an end of the second guide surface, and wherein an end of the second side of the slot joins an end of the third guide surface.

18. The refrigerator of claim 6, wherein the second guide surface comprises a helical surface that extends in a first spiral direction, and wherein the third guide surface comprises a helical surface that extends in a second spiral direction.

19. The refrigerator of claim 1, further comprising a biasing member that urges the duct cap to the closed position.

* * * * *